US011064751B2

(12) United States Patent
McBride et al.

(10) Patent No.: US 11,064,751 B2
(45) Date of Patent: Jul. 20, 2021

(54) HEADWEAR IMPLEMENT WITH REAR APERTURE

(71) Applicants: Andrea L. McBride, Las Vegas, NV (US); Steve C. McBride, Las Vegas, NV (US)

(72) Inventors: Andrea L. McBride, Las Vegas, NV (US); Steve C. McBride, Las Vegas, NV (US)

( * ) Notice: Subject to any disclaimer, the term of this patent is extended or adjusted under 35 U.S.C. 154(b) by 43 days.

(21) Appl. No.: 16/286,317

(22) Filed: Feb. 26, 2019

(65) Prior Publication Data

US 2020/0022442 A1 Jan. 23, 2020

Related U.S. Application Data

(60) Provisional application No. 62/764,123, filed on Jul. 20, 2018.

(51) Int. Cl.

| | |
|---|---|
| ***A42B 1/22*** | (2006.01) |
| ***A42C 5/04*** | (2006.01) |
| ***A42B 1/02*** | (2006.01) |
| ***A42B 1/008*** | (2021.01) |

(52) U.S. Cl.

CPC ..... *A42B 1/225* (2013.01); *A42B 1/008* (2013.01); *A42B 1/02* (2013.01); *A42C 5/04* (2013.01)

(58) Field of Classification Search

CPC ..... A42B 1/225; A42B 1/02; A42B 1/008; A42B 1/14

See application file for complete search history.

(56) References Cited

U.S. PATENT DOCUMENTS

| | | | | | |
|---|---|---|---|---|---|
| 829,818 | A * | 8/1906 | Webb | A42B 1/14 | 2/209.4 |
| 1,518,941 | A * | 12/1924 | Solomon | A42C 5/04 | 2/182.8 |
| 1,535,389 | A * | 4/1925 | Wittcoff | A42B 1/14 | 2/175.2 |
| 1,629,062 | A * | 5/1927 | Artau | A42B 1/02 | 2/209.7 |
| 1,991,829 | A * | 2/1935 | Uriwal | A42B 1/14 | 2/209.7 |
| 3,206,766 | A * | 9/1965 | Smith | A42C 5/04 | 2/209.7 |
| D350,427 | S * | 9/1994 | Vig | 2/175.1 | |
| 5,644,799 | A * | 7/1997 | Armenta | A42B 1/225 | 132/273 |

(Continued)

*Primary Examiner* — Christopher R Harmon

(74) *Attorney, Agent, or Firm* — Invention To Patent Services; Alex Hobson

(57) ABSTRACT

A device including a crown or dome section having a proximate upper portion, a proximate lower portion, and a proximate bottom end portion, in which the proximate bottom end portion comprises an interior and outer surface area; a ring segment having a plurality of holes or vent in a mesh pattern that is configured to allow airflow or ventilation; an aperture portion that is configured to be operable for allowing the hair to project out an interior of the crown or dome section to generally prevent hat hair; a hem segment that is configured to be operable for preventing hair from snagging and tangling upon the aperture portion; and an interior padding portion configured to cover and pad the interior surface area of the proximate bottom end portion to provide comfort during wear.

4 Claims, 6 Drawing Sheets

(56) References Cited

U.S. PATENT DOCUMENTS

| | | | | |
|---|---|---|---|---|
| 7,454,799 | B2 * | 11/2008 | Wuensche | A42B 1/225 2/171 |
| D692,213 | S * | 10/2013 | Brack | D2/891 |
| D749,307 | S * | 2/2016 | Denny | A42B 1/08 D2/887 |
| D749,826 | S * | 2/2016 | Denny | D2/882 |
| D857,343 | S * | 8/2019 | Tseng | D2/866 |
| 2007/0022516 | A1 * | 2/2007 | Wuensche | A42B 1/225 2/172 |
| 2009/0151047 | A1 * | 6/2009 | Garza | A42B 1/225 2/174 |

* cited by examiner

HEADWEAR IMPLEMENT WITH REAR APERTURE

CROSS-REFERENCE TO RELATED APPLICATIONS

The present Utility patent application claims priority benefit of the U.S. provisional application for patent Ser. No. 62/764,123 entitled "Andy's Hats", filed on Jul. 20, 2018, under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to a shaped covering for the head worn for protection, as a fashion item, or as shade for the face and/or eyes. More particularly, certain embodiments of the invention relate to headwear devices such as hats.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. Some reasons people do not wear hats or caps are that the hat band compresses the hair and leaves a formed depression or matting commonly known as "hat hair". Another reason is that hat bands and the hat itself cut off air circulation to the covered area of the head which may result in uncomfortable heating and resultant perspiration. It is challenging for individuals with long, thick, voluminous hair that opt to exercise outdoors, for example, walking, hiking, or jogging, to find a well-fitting protective head covering. In these situations, some choose to wear a skull cap while others avoid the skull cap as it presses the hair against the head causing significant discomfort. Thus, there are limited options available to these individuals, including not wearing a hat.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that typically, hats are worn outdoors in inclement weather to shield and protect the face and eyes from direct sunlight. One of the problems with wearing a hat as a protective cover from the elements is that the user gets a messy or flattened appearance of the hair, produced as a result of wearing and then removing a hat. Hats, like baseball caps, attempt to mitigate hat hair by having an opening at the rear of the hat. These hats work best for individuals with either very short hair or slim ponytails. For example, a typical baseball-type cap may include a crown, a visor and a headband. The crown is used for covering the head of a wearer to protect the wearer's head and secure the cap on the head. Some crowns may take a shape of a general hemisphere corresponding to a shape of a wearer's head. The crown may include several panels that are stitched together and connected with one another to define a single crown. People wear a hat with a specific goal or for a specific purpose, but which rarely gets fully realized. This is because the hat may not remain in place, or it may actually trap heat instead of protecting a user from it, or at minimum it may leave the user's appearance significantly marred when the user takes the hat off.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
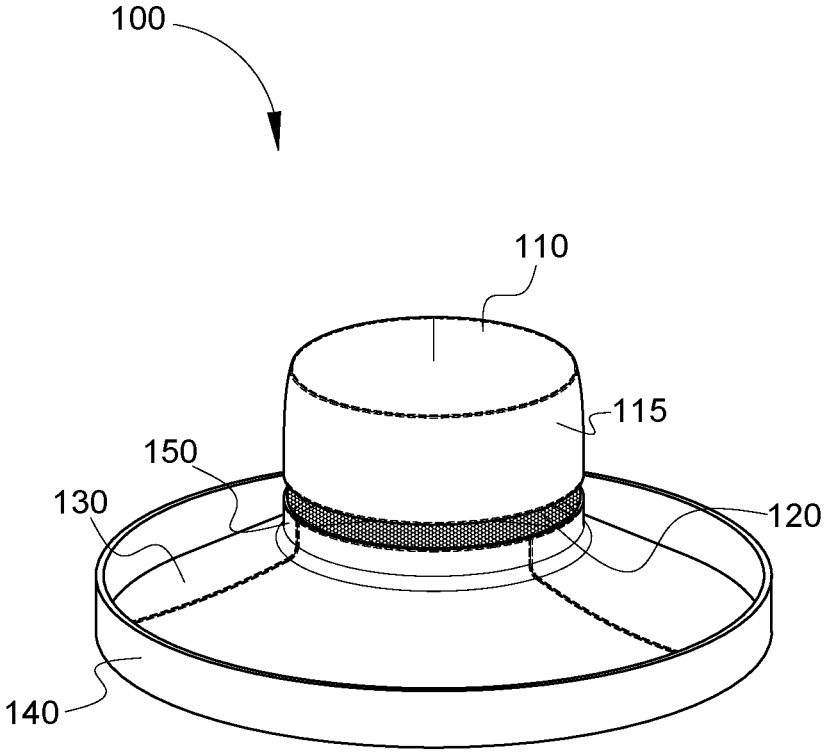
FIG. 1 is an illustration of an exemplary headwear implement, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially"

eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising" And "contain" and variations of them—Such terms are open-ended and mean "including but not limited to". When employed in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

All terms of exemplary language (e.g., including, without limitation, "such as", "like", "for example", "for instance", "similar to", etc.) are not exclusive of any other, potentially, unrelated, types of examples; thus, implicitly mean "by way of example, and not limitation . . . ", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of," should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary a variety of optional components is described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Some embodiments of the present invention and variations thereof, relate to headwear devices. In one embodiment of the present invention, the headwear implement features a brim section, a crown section extending from the brim section, an aperture portion disposed in a middle-rear plane of the crown section, and a ring segment with ventilation made from a durable, mesh material being disposed in a proximately lower portion of the crown section, engaging the brim section and the crown section. Through the aperture portion, a wearer may extend their hair, keeping it away from the crown section interior. By keeping much of the hair outside and away from the crown section's interior, the headwear implement commonly eliminates the problems that lead to "hat hair" and typically ensures the hat will remain appropriately fitted upon the wearer. Without having the hair clumped inside the crown section, the headwear implement isn't likely to slip and fall off the wearer. The hair isn't there to add to the heat that ordinarily gets trapped inside of a headwear device, and the hair-hosting aperture keeps hair off the wearer's neck. When the headwear implement is taken off, it doesn't leave that compressed ring on the hair, negatively affecting the wearer's appearance. The headwear implement of this invention may provide a better fit, better protection, and/or better results. The headwear implement of this invention may comprise of, but not limited to, a hat, a cap, a beanie, a beret, a fedora, a chupalla, a cowboy hat, a boonie hat, a sun hat, a bucket hat, a homburg hat, etc. The headwear implement may be made of, but not limited to, a nylon material, a cotton fabric, or a combination of both. The crown section may be about five-inches (5") in height. The proximate lower portion of the crown section may be made in mesh format. The bottom end portion of the crown section comprises a band. The aperture portion may be approximately one and three fourth inch (1¾) diameter in a proximate middle portion of a rear plane of the crown section. A hemmed border may be disposed about a proximate perimeter of the aperture portion. The brim section may comprise an approximate three-inch (3") length.

In some embodiments, the headwear implement of this invention may include a hat with a specialized and specifically-placed aperture in the rear crown section through which long hair may project, and may allow better fit, comfort, and appearance without negative results upon the wearer or their hair. Additionally, the headwear implement may feature a durable plastic ring segment with holes or venting within the crown section to allow air flow, and the durable ring segment supports the dome of the hat. An aperture portion may be disposed in the rear crown section of the hat. The hem of the aperture portion features a smooth lining that may prevent hair from sticking to it and therefore it won't uncomfortably pull the hair. Other hats with openings do not feature the smooth lining to prevent hair from getting pulled. The area of the crown section below the aperture portion, and about the entire circumference directly above the brim, is made of a durable plastic ring segment with a multitude of holes or vents. The ring segment allows for the passage of airflow. It may also provide support for the crown section/dome of the hat in an upright position. The lower portion of the plastic ring segment is padded to ensure comfortable wear.

In other embodiments, a new and improved hat is provided that may facilitate improved wearer comfort and protects the appearance of the wearer by featuring ventilation and a strategically-placed hair-projecting aperture. The proximate bottom of the crown section features a plastic ring section that includes apertures to allow airflow. The plastic ring section engages the crown section and brim section as a single unit. The ring section extends into the crown section and along the interior brim section of the hat. The plastic ring section provides the support that holds the crown section in a proximate upright position which prevents the crown section from collapsing on the brim section. If the apertures were merely integrated into the crown sections of soft fabric hats the crown section may collapse. The interior of the crown section may feature a cushioned band around the circumference of the crown section. The slightly cushioned band covers and pads the bottom, non-perforated portion of the plastic ring section to ensure user comfort during wear. The cushion pads the ring section against the wearer's head. The invention features a strategically-placed aperture portion located at the rear of the hat. The aperture portion features a finished hem of a smooth yet durable fabric or even plastic. The wearer may project their long hair through the aperture portion. The smooth finish of the hem is important as it prevents the wearer's hair from getting stuck, pulled or snagged. The proximate high placement of the hair-hosting aperture portion on the proximate back portion of the crown section is important as it allows the hair to project away from the neck and lay over the brim section of the hat. This ensures the hair doesn't gather on the brim section causing uncomfortable weight and keeps the hair off the neck of the user.

In additional embodiments, the aperture portion of the headwear implement may accept long hair of a wearer, and the hair is projected away from the hat by the brim section. The aperture portion may eliminate the need to trap long hair within the interior of the hat. By eliminating the need to trap long hair within the interior of the hat, a negative influence on the hair appearance may be prevented when the hat is removed. By eliminating the need to trap long hair within the interior of the hat, the hat will normally remain comfortably in place upon the wearer. The brim section may ensure protection from direct sunlight upon the head and face of the wearer. The durable plastic mesh material is disposed about the circumference of the crown and configured to support the crown section/dome of the hat in its intended shape, allow air circulation within the hat, allows heat to escape from the confines of the crown, and allows inflow of air within the hat. The aperture portion features a smoothly hemmed border, wherein the smooth hem of the aperture border is configured to help prevent hair from snagging on and being tangled upon said aperture, and to typically ensure the durability of the hat for long-time use and prevent the hat from tearing. In further embodiments, the hat is configured to satisfy established needs of persons with long hair, of persons who work in outdoor environments, who engage in outdoor hobbies and outdoor social activities.

The present invention will now be described in detail with reference to embodiments thereof as illustrated in the accompanying drawings.

FIG. 1 is an illustration of an exemplary front portion of a headwear implement, in accordance with an embodiment of the present invention. In the present embodiment shown, the headwear implement 100 may comprise a brim section 130, a crown/dome section 110 substantially extending from the brim section 130. The crown/dome section 110 may comprise a proximate upper portion 115, a proximate lower portion 120, and a proximate bottom end portion 150. A ring segment 120 with holes or vent made with meshed material being disposed in the proximate lower portion of the crown section 110, engaging, in between, the proximate upper portion 115 and the bottom end portion 150. The ring segment 120 may comprise but is not limited to, a mesh plastic material. The plastic mesh material is disposed about the circumference of the crown section 110 and configured to, but not limited to, generally support the crown section 110 of the headwear implement 100 in its intended shape, allow air circulation within the headwear implement 100, allow heat to escape from the confines of the crown section 110, and allows inflow of air within the headwear implement 100. The proximate bottom end portion 150 of the crown/dome section 110 may comprise various sizes and shapes including but not limited to a proximate half spherical, round, oval, oblong and/or egg shape. The various sizes and shapes ensure the headwear implement 100 fits heads of various sizes and shapes. Further, the ring segment 120 is configured to support and hold the crown section 110 in a proximate upright position which prevents the crown section 110 from collapsing on the brim section 130. In addition, the lower portion of the ring segment 120 is essentially padded to ensure comfortable wear. The ring segment 120 may be produced from various suitable materials including, without limitation, plastic, rubber, fabric and any combination of those or other materials. Additionally, the apertures of the ring segment 120 may be round, square, triangular, oblong, diamond shaped, etc. The brim section 130 may encircle the crown section 110 and may comprise a brim section end portion 140 including but not limited to a proximate upward folding end portion. The brim section 130 is configured to protect the head and face from direct sunlight. Alternatively, the brim section 130 may encircle only a portion of the crown section 110. The brim section end portion 140 may comprise, but is not limited to, a proximate downward folding end portion and/or non-folding end portion. The headwear implement 100 may comprise, but are not limited to, a hat, a cap, a beanie, a beret, a fedora, a chupalla, a cowboy hat, a boonie hat, a sun hat, a bucket hat, a homburg hat, etc.

Figure 2:
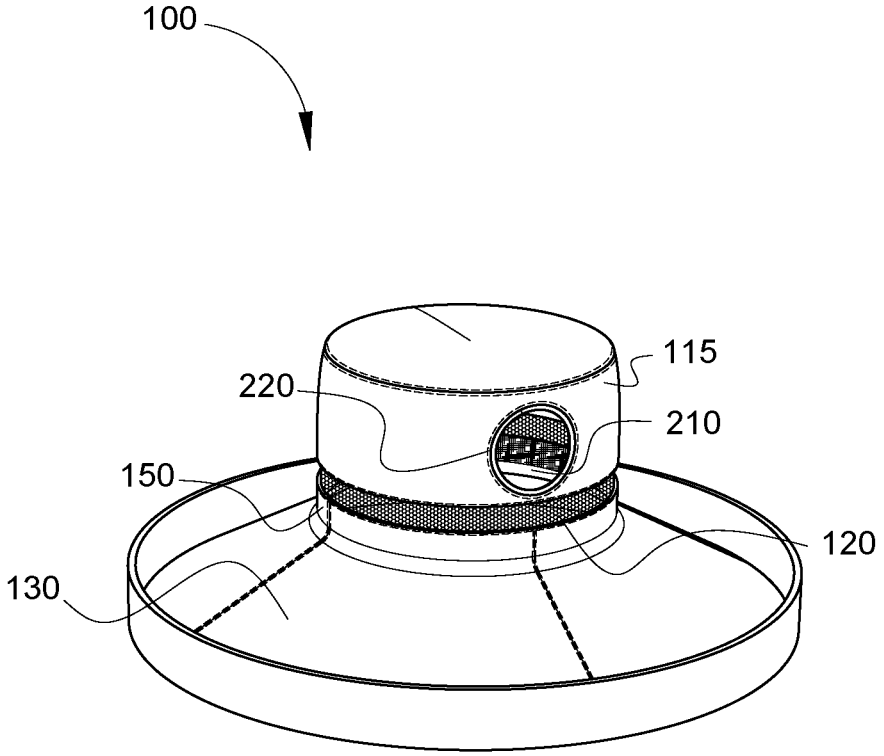
FIG. 2 is an illustration of an exemplary headwear implement with hair projecting aperture, in accordance with an embodiment of the present invention.

FIG. 2 is an illustration of an exemplary rear portion of a headwear implement 100, in accordance with an embodiment of the present invention. In the present embodiment shown, the headwear implement 100 may comprise an aperture portion 210 disposed in a middle-rear plane of the crown section 110, proximately above the ring segment 120. Through the aperture portion 210, a wearer may extend their hair, keeping it away from the crown section interior. By keeping much of the hair outside and away from the crown section interior, the headwear implement 100 may eliminate the problems that lead to "hat hair" and a poor fitting hat. Moreover, a proximately high placement of the hair-hosting aperture portion 210 on the proximate back portion of the crown section 110 is configured to allow the hair to project away from the neck and lay over the brim section 130 of the headwear implement 100. This generally ensures the hair doesn't gather on the brim section 130 causing uncomfortable weight and keeps the hair off the neck of the user. Without having the hair clumped inside the crown section 110, the headwear implement 100 isn't likely to slip and fall off the head of the wearer. The aperture portion 210 may feature a hem segment lining the periphery of the aperture portion 210. The hem segment is a generally smooth hemmed border 220, wherein the smooth hem 220 of the aperture portion 210 is configured to prevent hair from snagging on and being tangled upon said aperture portion 210, prevent hair from snagging and tangling upon the aperture, and/or ensure the durability of the headwear implement 100 for long-time use and prevent the headwear implement 100 from tearing.

Figure 3:
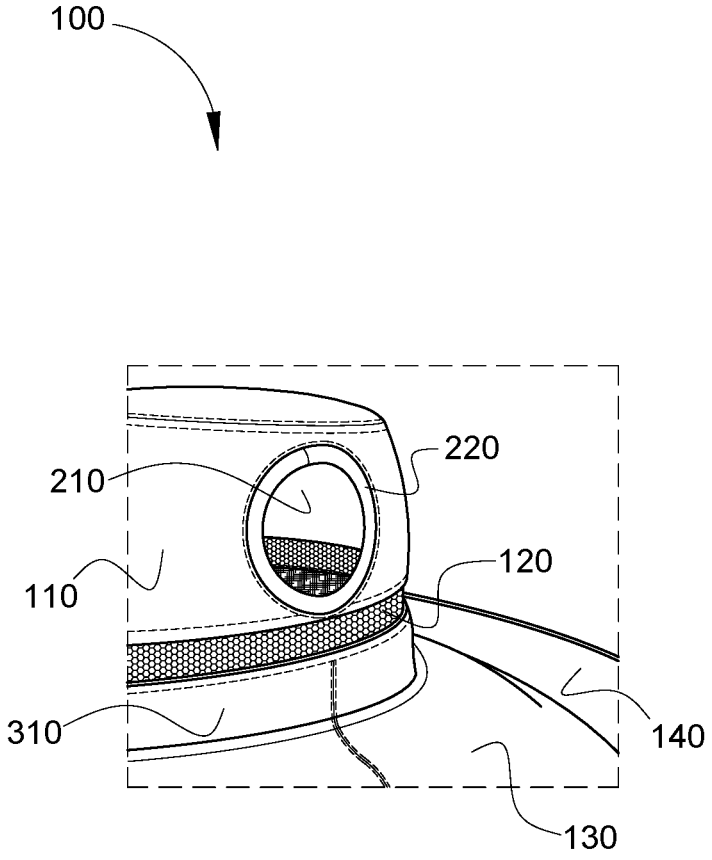
FIG. 3 is an illustration of an expanded back portion of an exemplary headwear implement, in accordance with an embodiment of the present invention.

FIG. 3 is an illustration of an expanded rear portion of an exemplary headwear implement, in accordance with an embodiment of the present invention. In the present embodiment shown, the headwear implement 100 may comprise a brim section 130, a crown/dome section 110 extending from the brim section 130, a ring segment 120 with holes or vents made from a meshed plastic material being disposed in a proximately lower portion of the crown section 110, engaging the brim section 130 and the crown/dome section 110, and an aperture portion 210 disposed in a middle-rear plane of the crown section 110, proximately above the ring segment 120. The headwear implement 100 may further comprise an outer padded portion 310 disposed in a proximate bottom end portion 150 of the crown/dome section 110. The outer padding portion 310 provides support for the crown/dome section 110. The proximate bottom portion of the ring segment 120 is padded to generally ensure comfortable wear. Through the aperture portion 210, a wearer may extend their hair, generally keeping it away from the crown section interior. By keeping much of the hair outside and away from the crown section interior, the headwear implement 100 may eliminate the problems that lead to "hat hair" and a poor fitting hat. Without having the hair clumped inside the crown section 110, the headwear implement 100 is not likely to slip and fall off the head of the wearer. The aperture portion 210 may feature a smoothly hemmed border 220, wherein the smooth hem 220 of the aperture portion 210 is configured to prevent hair from snagging on and being tangled upon said aperture portion 210, prevent hair from snagging and tangling upon the aperture, and/or ensure the durability of the headwear implement 100 for long-time use and considerably prevent the headwear implement 100 from tearing. The material that comprises the hem may be cotton, nylon, silk, satin, linen, bamboo fabric, velvet, fleece, and suede.

Figure 4:
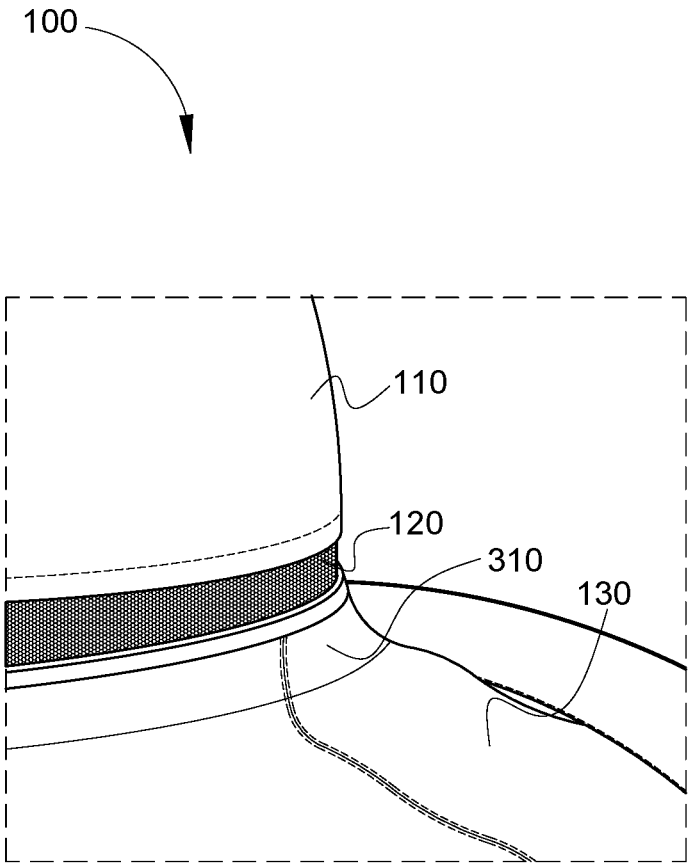
FIG. 4 is an illustration of an expanded front portion of exemplary headwear implement, in accordance with an embodiment of the present invention.

FIG. 4 is an illustration of an expanded front portion of an exemplary headwear implement, in accordance with an embodiment of the present invention. In the present embodiment shown, the ring segment 120 comprises holes or vent made with meshed material being disposed in a proximate lower portion of the crown section 110, engaging the brim section 130 and the crown/dome section 110. In addition, the ring segment 120 may comprise, without limitation, a plastic mesh material. The plastic mesh material is disposed about the circumference of the crown section 110 and configured to, but not limited to, significantly support the crown section 110 of the headwear implement 100 in its intended shape, allow air circulation within the headwear implement 100, allows heat to escape from the confines of the crown section 110, and allows inflow of air within the headwear implement 100. Further, the ring segment 120 is configured to support and hold the crown section 110 in a proximate upright position which prevents the crown section 110 from collapsing on the brim section 130. The ring segment 120 is stitched between the upper portion and the bottom end portion of the crown section 110. In addition, the bottom end portion 150 outer padding 310 is configured to provide support to the crown section 110 and to ensure comfortable wear.

Figure 5:
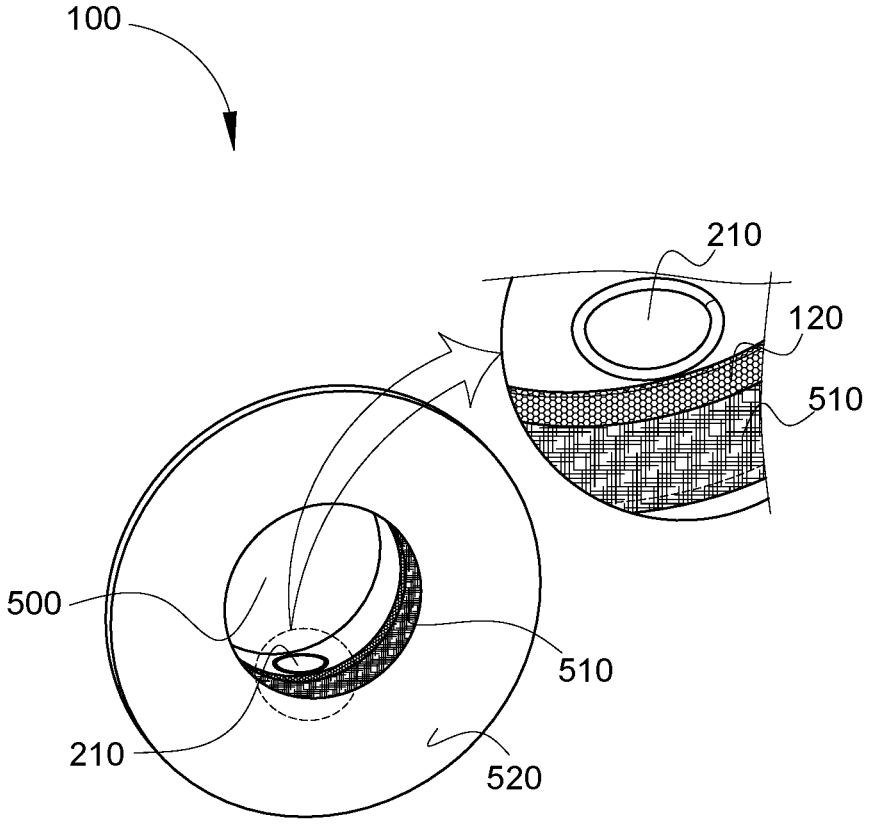
FIG. 5 is an illustration of an underside of an exemplary headwear implement, in accordance with an embodiment of the present invention.

FIG. 5 is an illustration of an underside of an exemplary headwear implement, in accordance with an embodiment of the present invention. In the present embodiment shown, the bottom end portion may further comprise an interior padding portion 510 that engages the interior surface area of the bottom end portion. The interior padding portion 510 engages the interior portion of the brim section 520 and the lower portion of an interior portion 500 of the crown section. The interior padding portion 510 forms as a band corresponding to the periphery of a wearer's head. The band may prevent sweat from running down from the inside of the crown section and lightly presses against the wearer's head so that the headwear implement 100 cannot easily fall from the head. The aperture portion 210 disposed in a middle-rear plane of the crown section interior 500, proximately above the ring segment 120 is easily accessible so a wearer may extend their hair, keeping it away from the interior of the crown section 500. In other embodiments, the interior portion of the crown section 500 features a cushioned band 510 around the circumference of the interior portion of the crown section 500. The cushioned band 510 covers and pads the bottom, non-perforated portion of the ring segment 120 to ensure user comfort during wear. The cushioned band 510 pads the ring segment 120 against the wearer's head. The cushioned band 510 may prevent sweat from running down from the inside of the crown and lightly presses the wearer's head into direct contact with the interior portion of the crown section 500 so that the headwear implement 100 cannot easily fall from the head. The pad can be produced from foam, rubber or cotton. Additionally, the pad may be protectively covered by fabric and/or leather.

Figure 6:
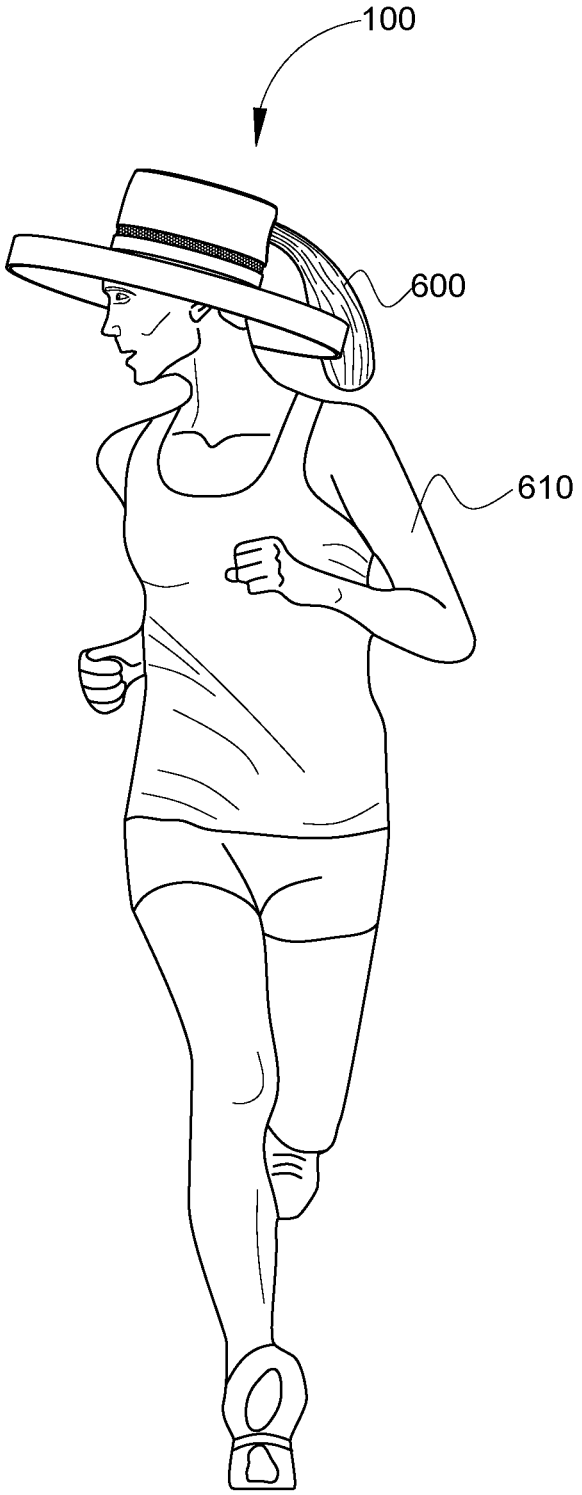
FIG. 6 is an illustration of an exemplary usage of a headwear implement, in accordance with an embodiment of the present invention.

FIG. 6 is an illustration of an exemplary usage of a headwear implement, in accordance with an embodiment of the present invention. In the present embodiment shown, the headwear implement 100 may be worn by a user 610 during an exercise, i.e. jogging. The long hair 600 of the user is essentially being projected away from the user's neck.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" or "steps for" claim limitation implies that the broadest initial search on 35 USC § 112(6)

(post AIA 112(f)) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112(6) (post AIA 112(f)) when such corresponding structures are not explicitly disclosed in the foregoing patent specification. Therefore, for any invention element(s)/structure(s) corresponding to functional claim limitation(s), in the below claims interpreted under 35 USC § 112(6) (post AIA 112(f)), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112(6) (post AIA 112(f)) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112(6) (post AIA 112(f)), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing headwear devices according to the present invention will be apparent to those skilled in the art. Various aspects of the invention have been described above by way of illustration, and the specific embodiments disclosed are not intended to limit the invention to the particular forms disclosed. The particular implementation of the headwear devices may vary depending upon the particular context or application. By way of example, and not limitation, the headwear implement described in the foregoing was principally directed to soft style hats; however, similar techniques may instead be applied to hard hats, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A hat consisting of:

a crown or dome section, said crown or dome section comprises a proximate upper portion, a proximate lower portion, and a proximate bottom end portion, in which said proximate bottom end portion comprises an interior and outer surface area;

a ring segment, said ring segment is into engagement with said proximate lower portion of said crown or dome section;

wherein said ring segment comprises a plurality of holes in a mesh pattern that is configured to allow airflow or ventilation;

an aperture portion disposed in said proximate upper portion of said crown or dome section, proximately above said ring segment, wherein said aperture portion is configured to be operable for allowing hair to project out of said interior of said crown or dome section;

a hem segment, said hem segment is configured to line the periphery of said aperture portion, wherein said hem segment comprises at least one of, a smooth fabric, nylon, and plastic that is configured to be operable for preventing hair from snagging and tangling upon said aperture portion;

a brim section, said brim section is configured to protect a head and face from sunlight, said brim section comprises a proximate upward folding end portion, wherein said brim section is configured to encircle said crown or dome section;

said ring segment further comprises a plastic ring segment that is configured to prevent said crown or dome section from collapsing on the brim section and configured to provide for said crown or dome section to generally remain in an upright position;

an outer padding portion disposed in said proximate bottom end portion and configured to support said brim section of said crown or dome section; and an interior padding portion, said interior padding portion is into engagement with said interior surface area of said proximate bottom end portion of said crown or dome section, wherein said interior padding portion is configured to cover and pad said interior surface area of said proximate bottom end portion to provide comfort during wear.

2. The hat of claim 1, in which said hat is made from a nylon material.

3. The hat of claim 1, in which said proximate bottom end portion of said crown or dome section comprises a band.

4. A hat consisting of:

a crown or dome section, said crown or dome section comprises a proximate upper portion, a proximate lower portion, and a proximate bottom end portion, in which said proximate bottom end portion comprises an interior and outer surface area;

a ring segment, said ring segment is into engagement with said proximate lower portion of said crown or dome section;

wherein said ring segment comprises a plurality of holes in a mesh pattern that is configured to allow airflow or ventilation;

an aperture portion disposed in said proximate upper portion of said crown or dome section, proximately above said ring segment, wherein said aperture portion is configured to be operable for allowing the hair to project out of an interior of said crown or dome section to generally prevent hat hair;

a hem segment, said hem segment is configured to line the periphery of said aperture portion, wherein said hem segment comprises at least one of, a smooth fabric, nylon, and plastic that is configured to be operable for preventing hair from snagging and tangling upon said aperture portion;

an interior padding portion, said interior padding portion is into engagement with said interior surface area of said proximate bottom end portion of said crown or dome section, wherein said interior padding portion is configured to cover and pad said interior surface area of said proximate bottom end portion to provide comfort during wear; and a brim section, said brim section is configured to protect a head and face from sunlight said brim section being configured to encircle said crown or dome section, said brim section having a proximate upward folding end portion, said ring segment further having a plastic ring segment configured to prevent said crown or dome section from collapsing on the brim section and configured to support said brim section of said crown or dome section to generally remain in an upright position, an outer padding portion disposed in an outer surface area of said proximate bottom end portion and configured to support said crown or dome section, said proximate bottom end portion of said crown or dome section having an outer padded pad.

* * * * *